US007662238B2

(12) United States Patent
Garner et al.

(10) Patent No.: US 7,662,238 B2
(45) Date of Patent: Feb. 16, 2010

(54) POWDERED COIL CLEANER

(75) Inventors: Scott Garner, Valley Park, MO (US); Joseph Raible, Valley Park, MO (US)

(73) Assignee: Germany Company, Inc., Valley Park, MO (US)

( * ) Notice: Subject to any disclaimer, the term of this patent is extended or adjusted under 35 U.S.C. 154(b) by 4 days.

(21) Appl. No.: 11/756,495

(22) Filed: May 31, 2007

(65) Prior Publication Data

US 2007/0281876 A1 Dec. 6, 2007

Related U.S. Application Data

(60) Provisional application No. 60/809,602, filed on May 31, 2006.

(51) Int. Cl.
*B08B 1/00* (2006.01)
*C11D 3/20* (2006.01)

(52) U.S. Cl. ..... 134/14; 510/245; 510/272; 510/254; 510/201; 510/202; 510/207; 510/212; 510/184; 510/367; 510/375; 510/378; 134/22.11; 134/22.17; 165/95

(58) Field of Classification Search ..... 510/365, 510/184, 367, 375, 378, 245; 134/14, 22.11, 134/22.17; 165/95
See application file for complete search history.

(56) References Cited

U.S. PATENT DOCUMENTS

| | | | | |
|---|---|---|---|---|
| 3,145,178 | A * | 8/1964 | Boettner et. al. | 510/245 |
| 4,435,223 | A * | 3/1984 | Dollman | 134/3 |
| 4,521,332 | A * | 6/1985 | Milora | 510/272 |
| 4,595,520 | A * | 6/1986 | Heile et al. | 510/380 |
| 4,602,963 | A * | 7/1986 | Piatkowski | 134/2 |
| 5,217,433 | A * | 6/1993 | Bunin | 604/89 |
| 5,279,357 | A * | 1/1994 | Kennon et al. | 165/95 |
| 5,955,412 | A * | 9/1999 | Post et al. | 510/247 |
| 6,124,250 | A | 9/2000 | Olson et al. | |
| 6,211,141 | B1 | 4/2001 | Yamaguchi et al. | |
| 6,550,647 | B1 * | 4/2003 | Kunz | 222/129 |
| 6,589,924 | B2 | 7/2003 | Schmidt et al. | |
| 7,338,564 | B2 * | 3/2008 | Garner et al. | 134/14 |

OTHER PUBLICATIONS

CHEMTEC Chemical Co, Rhodia product information pdf.*
Material Safety Data Sheet dated Nov. 21, 2005 regarding Instant Powder Kegs, 5 pages.
Material Safety Data Sheet regarding EV Coil Max, 3 pages.
High Performance Coil Cleaner in a Powder Form regarding EV Coil Max Powder Coil Cleaner, 5 pages.

* cited by examiner

*Primary Examiner*—Mark Eashoo
*Assistant Examiner*—Jane L Stanley
(74) *Attorney, Agent, or Firm*—Senniger Powers LLP

(57) ABSTRACT

Prepackaged cleaning compositions are described which are suitable for on-site dilution, and for cleaning substrates such as air conditioner coils.

14 Claims, No Drawings

POWDERED COIL CLEANER

REFERENCE TO RELATED APPLICATIONS

This application claims the benefit of Provisional Patent Application Ser. No. 60/809,602, filed May 31, 2006, the entire contents of which are incorporated herein by reference.

FIELD OF THE INVENTION

The present invention relates generally to cleaning compositions or formulations used to clean substrates such as air conditioning coils, electronic air filters and other types of metal filters.

BACKGROUND OF THE INVENTION

Historically, cleaners used to clean air conditioning coils, electronic air filters and other types of metal filters have been sold in fairly concentrated liquid form, typically in 1 gallon, 5 gallon and 55 gallon containers. The servicemen would mix the product with water (typically 2 or 3 parts water to one part cleaner) in a 1, 2, or 3 gallon pump sprayer, then spray the diluted product onto the surface that needed to be cleaned.

Typically, three types of cleaners are used—acid coil cleaners, non-acid coil cleaners and evaporator coil cleaners. Acid coil cleaners include hydrofluoric acid as the active ingredient and are used on condenser coils located outdoors. Non-acid coil cleaners include either sodium hydroxide, potassium hydroxide or a combination of the two as the active ingredient and can be used on both condenser and evaporator coils. Evaporator coil cleaners are typically alkaline cleaners formulated with various surfactants. They are used primarily on evaporator coils located indoors but can be used on condenser coils outdoors as well.

Several problems exist with the current liquid cleaners such as storage space and transportation requirements, spilling or leakage, and dilution errors.

The current demand for higher efficiency systems has caused air conditioning (A/C) units to become larger, thereby occupying significantly more space in the wholesaler's or the serviceman's warehouse. Liquid coil cleaners also occupy significant warehouse space. Liquid coil cleaners are purchased in case quantities (4 gallons per case) that take up a little more than one cubic foot per case and cases are bought in pallet quantities taking up 48 cubic feet of space or approximately a 3 ft×4 ft area. Liquid coil cleaners also take up significant storage space in a serviceman's truck, since about 8 gallons of cleaner or 2 cubic feet of truck space is required for one day of service calls.

It is not uncommon for a serviceman to accidentally puncture the liquid coil cleaner container in the truck and have highly corrosive liquids spill and damage the truck and tools. Wholesalers have similar problems with containers forming leaks when bottles are knocked off shelves or fork-lift trucks puncture cases of the liquid cleaner. Such spilled liquid cleaners can corrode floors, shelves and other merchandise.

Servicemen can also err in diluting concentrated cleaners. Without some type of additional measuring device it can be very difficult to accurately blend 2 or 3 parts water to one part cleaner and mix it in a pump-up sprayer. Servicemen habitually generate "diluted" cleaners that are either too dilute or too concentrated.

Furthermore, liquid cleaners, typically contain 70 wt. % to 80 wt. % water, which adds additional freight cost due to added weight and additional charges for transporting hazardous liquid formulations.

Prior attempts have been made by others to address some of these problems. A powdered cleaner, EV COIL MAX® is available from Highside Chemicals, Inc., Gulfport, Miss., USA. This product is reported to contain sodium metasilicate pentahydrate (a hazardous respirable dust with a 2 mg/m$^3$ recommended ceiling) and sodium lauryl sarcosine. While this product is prepackaged for 1 gallon dilution, the instructions suggest further dilution to up to 3 gallons. Hence, the mixing problem still exists. A second powdered cleaner, HL COIL BRITE™ is also available from Highside Chemicals, Inc., Gulfport, Miss., USA. This product is an acid based coil cleaner containing ammonium bifluoride (ABF; ammonium hydrogendifluoride). Another product, Instant Powder Kegs™, is available from Controlled Release Technologies, Inc., Clearwater, Fla., USA. This product contains sodium silicate and is combined with sodium hydroxide, a corrosive alkaline product.

SUMMARY OF THE INVENTION

Conventional cleaning compositions have several deficiencies, as explained above. The invention now provides a way to overcome these deficiencies, by providing an alkali- or acid-based powdered cleaning composition that can be prepackaged and accurately formulated as an aqueous ready-to-use solution at the worksite.

Briefly, therefore, the present invention is directed to a powdered coil cleaner composition, the composition comprising about 40-97 wt. % strong alkali, preferably about 70-80 wt. % strong alkali, about 1-20 wt. % surfactant, up to about 5 wt. % thickener, up to about 15 wt. % chelating agent; up to about 55 wt. % filler, and up to about 5 wt. % dust control agent.

The present invention is directed to a powdered coil cleaner composition, the composition comprising about 30-95 wt. % acid source, about 1-20 wt. % surfactant, up to about 0.1-5 wt. % thickener, up to about 15 wt. % chelating agent; up to about 65 wt. % filler, and up to about 5 wt. % dust control agent.

The present invention is further directed to a container comprising a pre-measured amount of any of the powdered coil cleaner compositions described above, wherein the amount of said composition in said container is sufficient to form an effective coil cleaner solution when mixed with about 0.5 to about 3 gallons of water.

The present invention is further directed to a method of cleaning a substrate, said method comprising mixing a pre-measured amount of any of the powdered coil cleaner composition described above into about 0.5 to about 3 gallons of water to create a solution; and applying said solution to said substrate.

DETAILED DESCRIPTION OF THE PREFERRED EMBODIMENTS

The present invention, therefore, provides powdered cleaners that are pre-measured for one time use and can be packaged in easy-tear pouches. The amount of dry powder required to make 8 gallons of a liquid cleaner (2 cubic ft) takes up 0.35 cubic ft, representing an 83 wt. % reduction in storage space for the powdered cleaner as compared to the liquid cleaner. If a bag tears open, the powdered cleaner can be swept up without damaging the surface where it was spilled since the powders are less invasive. Also, these powdered cleaners are pre-measured so that one bag can be mixed with one half gallon or one gallon of water in a pump up sprayer to achieve the correct concentration. Moreover, the amount of powdered cleaner required to make one gallon of liquid cleaner weighs 0.5 lbs. This amounts to an 80 wt. % reduction in weight, which results in a tremendous savings in freight cost. Further, since the powder is packaged in single use packets, it is no longer classified as hazardous by the Department of Transportation (D.O.T.) and does not incur hazardous freight charges.

In one embodiment, the powdered cleaner composition of the invention comprises an alkali source and a surfactant. The alkali source can be any compound which liberates hydroxide in aqueous solution to generate a pH of about 12 to about 14. Caustic based coil cleaners function by attacking a metal surface liberating gas and generating heavy foam. This foam then forces particulate matter out of the coil and prevents material from accumulating deep inside the coil. Alkali metal hydroxides such as sodium hydroxide (caustic soda), potassium hydroxide (caustic potash) and lithium hydroxide are preferred. The amount of alkali in the composition of the invention will normally be in the range of from about 40-97 wt. %, about 60-90 wt. %, about 70-80 wt. %, preferably about 77 wt. %.

In another embodiment, the powdered cleaner composition of the invention comprises an acid source, and a surfactant. As with the caustic cleaners, high foaming as a result of metal attack of the cleaning agent is preferred for the acid type of cleaner. For acid based powder coil cleaners, any water-soluble solid acid, resulting in a final solution pH of 2.5-3.5 can be utilized. While both citric and sulfamic acids have been tested for appropriateness in this application and show desirable characteristics, others include glycolic acid, trichloroacetic acid, or maleic acid. Hydrofluoric acid (HF) is the preferred acidic cleaning agent; hence, materials or combinations of materials which generate HF in solution are viable. A pH range of about 2.0 to about 4.0 is sufficient to generate reasonable concentrations of HF from fluoride salts. Typically, a fluoride salt is combined with other chemicals or acids so as to lower the pH to about 4 or lower, preferably a pH from about 3.0 to about 3.5. Preferred fluoride salts comprise ammonium bifluoride, sodium bifluoride, sodium fluoride, ammonium fluoride, or potassium fluoride. When used in combination with any organic acid or inorganic acid, the fluoride salts would generate the appropriate solution containing the HF. Preferred organic acid or inorganic acid comprise, but are not limited to sulfamic acid, citric acid, trichloroacetic acid, glycolic acid, toluene sulfonic acid and camphor sulfamic acid. A mixture of ammonium bifluoride and sulfamic acid or citric acid is preferred. The total amount of the acid source in the composition of the invention will normally be up to about 95 wt. %, preferably about 30-95 wt. %, 60-95 wt. %, 70-95 wt. % or 80-95 wt. %; and can be present in an amount of about 30, 35, 40, 45, 50, 55, 60, 65, 70, 75, 80, 85, 90 or 95 wt. %. In some embodiments, the acid source includes about 10-60 wt. % fluoride salt and about 20-85 wt. % organic acid, preferably about 25-60 wt. % fluoride salt and about 30-72 wt. % organic acid.

The compositions of the invention further contain at least one surfactant, generally in an amount of from about 1 wt. % to about 20 wt. %. The surface-active agent can be anionic, nonionic, cationic, amphoteric or zwitterionic or a mixture of such agents that are available as dry components or can be formulated into a dry powder. The surfactants are chosen for their detergency and foaming ability. High foaming detergents are generally preferred; however, low foaming detergents can be used. Detergents that produce long lasting and durable foams are also preferred. While the primary goal is detergency and degreasing ability, dispersant characteristics are also desirable.

Suitable anionic surfactants to be used in compositions of the invention comprise linear alkyl benzene sulfonate, alkyl ester sulfonate surfactants, $C_8$-$C_{22}$ primary or secondary alkanesulfonates, $C_8$-$C_{24}$ olefinsulfonates, sulfonated polycarboxylic acids, $C_8$-$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, alkyl succinamates and sulfosuccinates, monoesters of sulfosuccinates (especially saturated and unsaturated $C_{12}$-$C_{18}$ monoesters) and diesters of sulfosuccinates (especially saturated and unsaturated $C_6$-$C_{12}$ diesters), acyl sarcosinates, sulfates of alkylpolysaccharides such as the sulfates of alkylpolyglucoside (the nonionic non-sulfated compounds being described below), branched primary alkyl sulfates, and alkyl polyethoxy carboxylates. Resin acids and hydrogenated resin acids are also suitable, such as rosin, hydrogenated rosin, and resin acids and hydrogenated resin acids present in or derived from tall oil. Other preferred anionic surfactants include alkyl alkoxylated sulfates such as $C_{12}$-$C_{18}$ alkyl polyethoxylate (1.0) sulfate, $C_{12}$-$C_{18}$ alkyl polyethoxylate (2.25) sulfate, $C_{12}$-$C_{18}$ alkyl polyethoxylate (3.0) sulfate, and $C_{12}$-$C_{18}$ alkyl polyethoxylate (4.0) sulfate.

Preferred anionic surfactants suitable for use in formulating the compositions of the invention include water-soluble salts of alkylbenzenesulfonates, alkyl sulfates, alkylpolyethoxyether sulfates, paraffin sulfonates, alpha-olefin sulfonates, alpha-sulfocarboxylates and their esters, alkylglycerylether sulfonates, fatty acid monoglyceride sulfates and sulfonates, alkylphenolpolyalkoxy ethersulfates, 2-acyloxyalkane-1-sulfonates and beta-alkyloxyalkane sulfonates. Preferred cleaning compositions comprise anionic surfactants or mixtures of anionic surfactants with other surfactants. Non-limiting examples of surfactants useful herein include the conventional $C_{11}$-$C_{18}$ alkyl benzene sulfonates and primary, secondary and random alkyl sulfates, the $C_{10}$-$C_{18}$ alkyl alkoxy sulfates, the $C_{10}$-$C_{18}$ alkyl polyglycosides and their corresponding sulfated polyglycosides, $C_{12}$-$C_{18}$ alpha-sulfonated fatty acid esters, $C_{12}$-$C_{18}$ alkyl and alkyl phenol alkoxylates (especially ethoxylates and mixed ethoxy/propoxy), $C_{12}$-$C_{18}$ betaines and sulfobetaines ("sultaines"), $C_{10}$-$C_{18}$ amine oxides, and the like. Highly preferred anionic surfactants are alpha olefin sulfonates, sodium lauryl sulfate, dodecyl benzyl sulfonates, and alkylamides with about 8 to about 24 carbon atoms, more especially about 12 to about 16 carbon atoms.

Cationic surfactants suitable for use in the cleaning compositions of the present invention include secondary amines, tertiary amines, mono- or di-alkoxylated amines, quaternary ammonium salts, di- or mono-alkoxylated quaternary ammonium salts, and ether amines. Examples of suitable compounds include, but are not limited to: coconut trimethyl ammonium chloride or bromide, coconut methyl dihydroxyethyl ammonium chloride or bromide, decyl triethyl ammonium chloride, decyl dimethyl hydroxyethyl ammonium chloride or bromide, $C_{12-15}$ dimethyl hydroxyethyl ammonium chloride or bromide, coconut dimethyl hydroxyethyl ammonium chloride or bromide; myristyl trimethyl ammonium methyl sulphate; and lauryl dimethyl benzyl ammonium chloride or bromide. The preferred cationic surfactants suitable for use in the invention include quaternary ammonium compounds, e.g. alkyltrimethylammonium salts, dibenzylammonium salts and dialkyldimethyl ammonium salts, and fatty alkyl amines.

Nonionic surfactants suitable for use in the present invention include ethoxylated and/or propoxylated adducts of aliphatic $C_{12-18}$ alcohols, alkyl amine oxides, alkyl polyglucosides and alkyl methylsulfoxides.

Zwitterionic surfactants that can be used in the present invention include water-soluble derivatives of aliphatic quaternary ammonium, phosphonium and sulfonium cationic compounds in which the aliphatic moieties can be straight or branched, and wherein one of the aliphatic substitutents contains from about 8 to 18 carbon atoms and one contains an anionic water-solubilizing group, especially alkyldimethylammonium propanesulfonates and carboxylates (betaines) and alkyldimethylammoniohydroxy propanesulfonates and carboxylates wherein the alkyl group in both types contains from about 8 to 18 carbon atoms.

Non-limiting examples of the classes and species of surfactants useful in this invention are described in "McCutcheon's, Emulsifiers and Detergents", 1989 Annual, (M. C. Publishing Co.), and in "Surface Active Agents", vols. I & II, Schwartz, Perry & Berch, (Interscience). These listings and the foregoing recitation of specific surfactant compounds and mixtures can be used in formulating the composition of the present invention, as can salts, esters, or other derivatives of the surfactants described herein.

In one embodiment, the surfactant comprises anionic or nonionic surfactants such as, alkyl amido betaines (e.g., lauramidopropyl betaine), hydrocarbyl sulfonate salts (e.g. aryl sulfonates such as sodium naphthalene sulfonate and sodium dodecyl benzene sulfonate; alkyl sulfonates such as sodium lauryl sulfonate; alkenyl sulfonates such as alpha olefin sulfonate), optionally substituted hydrocarbyl carboxylate salts (e.g. alkyl carboxylates such as disodium lauryl iminodipropionate, disodium lauryl sulfosuccinate, sodium oleyl methyl taurate; substituted alkyl carboxylates such as sorbitan monostearate, glycerol monostearate; polyalkylene glycol carboxylates such as polyethyleneglycol monostearate, polyethyleneglycol distearate, sorbitan tristearate, sodium cocoylisethionate), polymeric alcohol ethoxylates (e.g. alkaryl alcohol ethoxylates such as alcohol ethoxylate (nonylphenyl) MW 4.3K, alcohol ethoxylate (nonylphenyl) MW 1450, alcohol ethoxylate (nonylphenyl) MW 2670), polyethylene glycol/polypropylene glycol (PEG/PPG) copolymers with molecular weight (MW) from about 4700 (4.7K) to about 14,600 (14.6K) and mixtures thereof (e.g., PEG/PPG copolymer MW 12.6K with PEG/PPG ratio of about 1:2, PEG/PPG copolymer MW 14.6 k with PEG/PPG ratio of about 1:3), PEG/PPG alkylenediamine (e.g., PEG/PPG oxylated ethylenediamine MW 18 K, PEG/PPG oxylated ethylenediamine MW 15 K) and alkylamides (e.g., fatty acid alkylamino alkylamides such as stearamidoethyl diethylamine and stearamidopropyl dimethylamine; polyalkylene glycol alkylamides such as PEG alkylamides and PPG alkylamides; hydrogenated fat alkylamides such as hydrogenated palm alkylamides and hydrogenated tallow alkylamides; N-substituted alkylamides such as N-(2-hydroxyethyl) dodecanamide {Alkamide C-212} and mixtures thereof). In yet another embodiment, the surfactant is selected from the group consisting of alpha olefin sulfonate, disodium lauryl sulfosuccinate, sodium naphthalene sulfonate, sodium oleyl methyl taurate, disodium lauryl iminodipropionate, PEG/PPG copolymers MW from about 4.7K to about 14.6K and mixtures thereof, alcohol ethoxylate (nonylphenyl) MW 4.3K, sodium naphthalene sulfonate, sodium lauryl sulfate, dodecyl benzyl sulfonate (DDBSA), sodium oleyl methyl taurate (Geropon T77) and lauramidopropyl betaine (Mackam 1200). In a preferred embodiment, the surfactant is an alpha olefin sulfonate, sodium lauryl sulfate, sodium dodecyl benzyl sulfonate or N-(2-hydroxyethyl) dodecanamide {Alkamide C-212}.

While none of the powder coil cleaners require a thickening agent for cleaning purposes, incorporation of a thickening agent improves the overall quality of the product. Therefore, the compositions of the invention optionally further contain any thickener which increases the viscosity of the ultimate aqueous formulation and improves adhesion of the composition to the surface being cleaned. Non-limiting examples of suitable thickeners include xanthan gum, polyacrylic thickeners, guar gum, polyvinyl alcohol and cellulosic thickeners. In an embodiment, the thickener is a polyacrylate such as Goodrite™ K-7058D. In another embodiment, the thickener is xanthan gum. The thickeners can be present in the powdered formulation in an amount up to about 5 wt. %. In one embodiment, the thickener is present in an amount of from about 1 wt. % to about 4 wt. %. In another embodiment, the thickener is present in an amount of about 2 wt. %. Alternatively, utilization of some surfactants leads to very viscous solutions. In such instances, a thickening agent is neither necessary nor desirable and the formulation is devoid of thickener.

Other adjuvants which can be used in the compositions of the invention include chelating agents, fillers and dust control agents. Chelating agents aid the cleaning process by dissolving metal ion corrosions/deposits on the substrate and also provide additional surfactant capacity. Typical chelating agents comprise salts of phosphonic acids, sulfonic acids, polycarboxylic acids, aminocarboxylic acids or hydroxocarboxylic acids. In one embodiment, the chelating agent comprises salts of nitrilotrismethylene phosphonic acid, sodium xylene sulfate, sulfamic acid, EDTA, citric acid, oxalic acid, glycolic acid or gluconic acid. Of these, sodium gluconate, or EDTA and its salts, or mixtures of these are preferred. The chelating agent is used at a level of up to about 15% by weight of the total powder composition.

The dust control agent serves to minimize the release of dust particles from the powder into the environment to limit inhalation risk. Typical dust control agents include hydrolyzed sugars, ethylene glycol and propylene glycol; propylene glycol is preferred. These can be used at levels of about 0.1-5% by weight of the powder composition; preferably about 2% of the powder composition. Alternatively, the risk of exposure to dust particles from the cleaning agent is eliminated by use of a water soluble packaging material whereby the prepackaged unit is added directly to the predetermined amount of water without opening. In one embodiment, the composition is prepackaged in a water soluble material such as polyvinyl alcohol webbing for direct addition to water, so as to eliminate dust exposure.

A cleaning composition may include a filler which does not operate as a cleaning agent per se but cooperates with the cleaning agent to enhance the cleaning capacity of the composition. Any filler can be incorporated in the compositions herein to facilitate flow and compression of the powders. In some embodiments, the composition comprises up to about 25, 35, 45, 55 or 65 wt. % filler. Fillers include metal ion salts of carbonates, bicarbonates, sulfates, chlorides, silicates and metasilicates; starches, sugars, $C_1$-$C_{10}$ alkylene glycols and the like. Alkali and alkaline earth metal salts are preferred fillers in cleaning compositions. In one embodiment, the filler is sodium bicarbonate or sodium metasilicate. In another embodiment, the filler is sodium metasilicate.

In an embodiment of the invention, the alkali source is caustic soda, caustic potash, lithium hydroxide, or an alkali carbonate salt such as sodium carbonate, lithium caronate or potassium carbonate, the surfactant is selected from the group consisting of a powder or beaded alpha olefin sulfonate, sodium lauryl sulfate, dodecyl benzyl sulfonate, and alkylamides, and the thickener is selected from the group consisting of xanthan gum, polyacrylic thickeners, guar gum, and cellulosic thickeners. The composition of this embodiment further comprises up to about 15 wt. % of a chelating agent. In a further preferred embodiment, the chelating agent is sodium gluconate or EDTA and its salts or a mixture of these. In yet another embodiment, the composition additionally comprises a dust control agent such as from about 0.1-4 wt. % propylene glycol.

In one embodiment of the present invention, powdered coil cleaner composition comprises from about 40-97 wt. % caustic soda; from about 5-15 wt. % alpha olefin sulfonate; from about 0.1-5 wt. % xanthan gum or polyacrylate; up to about 15 wt. % sodium gluconate; up to about 5 wt. % EDTA; up to about 55 wt. % sodium metasilicate; and up to about 2 wt. % propylene glycol. Other embodiments of the invention include the use of similar alkali sources and surfactants, chelating agents, thickeners and dust control agents hereinbefore listed.

In a preferred embodiment of the invention, the powdered cleaning composition comprises about 79 wt. % caustic soda bead; about 8 wt. % alpha olefin sulfonate; about 0.5-1 wt. % xanthan gum or polyacrylate; about 10 wt. % sodium gluconate; and about 2 wt. % EDTA.

In another embodiment of the invention, the acid source is ammonium bifluoride, sulfamic acid or combinations thereof, the surfactant is selected from the group consisting of alpha olefin sulfonate, sodium lauryl sulfate, dodecyl benzyl sulfonate and alkylamides, and the thickener is selected from the group consisting of xanthan gum, polyacrylic thickeners, guar gum, polyvinyl alcohol and cellulosic thickeners.

In another embodiment, the acid source is ammonium bifluoride, sulfamic acid or combinations thereof, the surfactant is selected from the group consisting of a powder or beaded alpha olefin sulfonate, sodium lauryl sulfate, dodecyl benzyl sulfonate, and alkylamides, and the thickener is selected from the group consisting of xanthan gum, polyacrylic thickeners, guar gum, and cellulosic thickeners. The composition of this embodiment further comprises from about 1 wt. % to about 15 wt. % of a chelating agent. In a further preferred embodiment, the chelating agent is sodium gluconate, or EDTA and its salts, or a mixture therefrom. In the more preferred embodiment, the composition additionally comprises a dust control agent such as from about 0.1 wt. % to about 4 wt. % propylene glycol.

In one embodiment of the present invention, powdered coil cleaner composition comprises from about 25-60 wt. % ammonium bifluoride; from about 26-70 wt. % sulfamic acid, citric acid or mixtures thereof, from about 2-5 wt. % alpha olefin sulfonate; from about 1-5 wt. % xanthan gum or polyacrylate; up to about 2 wt. % EDTA; up to about 45 wt. % filler; and up to about 2 wt. % propylene glycol. Other embodiments of the invention include the use of similar acid sources and surfactants, chelating agents, fillers, thickeners and dust control agents hereinbefore listed.

In a preferred embodiment of the invention, the powdered cleaning composition comprises about 32 wt. % ammonium bifluoride; about 62 wt. % sulfamic acid; about 3 wt. % alpha olefin sulfonate; about 0.5-1 wt. % xanthan gum or polyacrylate; and about 2 wt. % EDTA. In another embodiment of the invention, the powdered cleaning composition comprises about 31 wt. % ammonium bifluoride; about 62 wt. % citric acid; about 3 wt. % alpha olefin sulfonate; about 0.5-1 wt. % xanthan gum or polyacrylate; about 2 wt. % EDTA; and about 0-2 wt. % propylene glycol. In yet another embodiment of the invention, the powdered cleaning composition comprises about 31 wt. % ammonium bifluoride; about 31 wt. % sulfamic acid; about 31 wt. % citric acid; about 3 wt. % alpha olefin sulfonate; about 0.5-1 wt. % xanthan gum or polyacrylate; about 2 wt. % EDTA; and about 0-2 wt. % propylene glycol.

Production of the powdered cleaning composition of the invention is accomplished by blending the components or by other means known in the art for powder formulations. For example, the composition can be made by top loading the dry raw materials into a ribbon mixer while blending. Propylene glycol is optionally added during blending to limit dust production. An auger based filling system is used to measure out the predetermined amounts of product, typically 4 oz. or 8 oz., into the packaging containers. The containers are then heat-sealed.

The invention is further directed to a method of cleaning substrates; said method comprising mixing a pre-measured amount of any of the above-described powdered coil cleaner compositions into about 0.5 to 3 gallons of water to create a solution; and applying said solution to a substrate. In some embodiments, the powdered cleaner is mixed into about 0.5, 1, 1.5, 2, 2.5, 3, 3.5, 4, 4.5 or 5 gallons of water. In an embodiment of the method of cleaning substrates, the solution is applied by spraying. The substrates comprise evaporator coils in general, air conditioning coils, condenser coils, electric air filters and other metal filters. In a preferred embodiment, the substrate is an evaporator coil in air conditioner units.

For cleaning applications, a single-use 8-oz package of the powdered composition of the invention is typically added to one gallon of water or a 4-oz package is added to a half gallon of water (1:1 dilution). However, if desired, two 8-oz packets of the powder can also be added to a one gallon of water (2:1 dilution) to yield a cleaning solution of greater strength, or one 8-oz packet of the powder can be added to three gallons of water (1:3 dilution) to yield a cleaning solution of weaker strength. Regarding the order of addition, it is preferred that the powder be added to the water in an appropriate container.

The invention is further directed to a container comprising a pre-measured amount of a powdered, coil cleaning composition as described above, wherein the amount of the composition in the container is sufficient to form an effective coil cleaner solution when mixed with about 0.5 to about 3 gallons of water. In an embodiment, the cleaning composition within the container comprises about 77 wt. % sodium percarbonate; about 8 wt. % alpha olefin sulfonate; about 0.5-1 wt. % xanthan gum or polyacrylate; about 10 wt. % sodium gluconate; and about 2 wt. % propylene glycol. In another embodiment, the cleaning composition within the container comprises about 77 wt. % caustic soda; about 8 wt. % alpha olefin sulfonate; about 0.5-1 wt. % xanthan gum or polyacrylate; about 10 wt. % sodium gluconate; about 2 wt. % EDTA; and about 2 wt. % propylene glycol. In yet another embodiment, the cleaning composition within the container comprises about 31 wt. % ammonium bifluoride; about 62 wt. % sulfamic acid, citric acid or mixtures thereof, about 3 wt. % alpha olefin sulfonate; about 0.5-1 wt. % xanthan gum or polyacrylate; about 2 wt. % EDTA; and about 0-2 wt. % propylene glycol.

In another embodiment, the container comprises a packet or an envelope. The composition of the container typically comprises water soluble polyvinyl alcohol (PVA) webbing, polyethylene, polypropylene, paper, foil, or polyurethane or any combination of these materials. The size of the container is typically in the range of about 4 oz. to about 16 oz., preferably from about 4 oz. to about 12 oz., more preferably about 4 oz. or 8 oz. In one embodiment, the container is a composite envelope consisting of 25 lb Bleached Machine Grade Paper/

7.2 lb Low Density Polyethylene/0.0003 mil Foil/14.4 lb Low Density Polyethylene (25 lb BL MG Paper/7.2 lb LDPE/0.0003 Foil/14.4 lb LDPE). In another embodiment, the container is a composite envelope consisting of 48 gauge Metallized Polyester/2.5 mil clear Linear Low Density Polyethylene (48 ga Metallized PET/2.5 mil cl LLDPE). In yet another embodiment, the container is a composite envelope consisting of form and fill packaging comprised wholly or in part of water-soluble polyvinyl alcohol webbing.

In another embodiment, the formulation incorporates powdered components and highly concentrated liquid components and the solid and liquid components are enclosed within separate compartments of a single multi-chambered packaging container. When the formulation includes powdered components and liquid components, the surfactants and/or thickeners can be present as solids or liquids. For example, an alkylpolyglucoside (Glucopon 625), alpha olefin sulfonate or any other highly concentrated surfactant previously stated above can be present in a liquid (first) compartment while the other dry components are present in a solid (second) compartment. Alternatively, a highly concentrated thickener solution such as a polyacrylate (Acusol 445) or xanthan gum can be present in the liquid compartment; and the other remaining components are present as dry solids in the solid compartment. Alternatively, the surfactant and thickener can be present as liquids in the first compartment; and the remaining components are present as dry solids in the second compartment. Additional surfactants and/or thickeners can also be included in the second compartment as desired.

The invention is further directed to a container comprising a solid component and a liquid component. In an embodiment of a caustic formulation described hereinabove, the liquid component comprises about 1-20 wt % surfactant based on the weight of the total formulation and the solid component comprises the other ingredients such as, up to about 5 wt % thickener; about 40-97 wt % alkali; up to about 15 wt % chelating agent; up to about 55 wt. % filler; and up to about 5 wt % dust control agent based on the weight of the total formulation. In another embodiment, the liquid component comprises about 0.1-5 wt % thickener based on the weight of the total formulation; and the solid component comprises other ingredients such as, about 40-97 wt % alkali; about 1-20 wt. % surfactant; up to about 15 wt % chelating agent; up to about 55 wt. % filler; and up to about 5 wt % dust control agent based on the weight of the total formulation. In yet another embodiment, the liquid component comprises about 1-20 wt. % surfactant and up to about 5 wt. % thickener based on the weight of the total formulation; and the solid component comprises; about 40-97 wt. % alkali; up to about 15 wt. % chelating agent; up to about 55 wt. % filler; and up to about 5 wt. % dust control agent based on the weight of the total formulation.

In another embodiment of a caustic formulation described above, the liquid component comprises about 5-15 wt. % alpha olefin sulfonate based on the weight of the total formulation; and the solid component comprises up to about 5 wt. % xanthan gum or polyacrylate; about 40-97 wt. % caustic soda; caustic potash or lithium hydroxide; up to about 5 wt. % sodium gluconate; up to about 5 wt. % EDTA; up to about 55 wt. % sodium metasilicate; and up to about 5 wt. % propylene glycol based on the weight of the total formulation. In another embodiment, the liquid component comprises about 0.1-5 wt % xanthan gum or polyacrylate based on the weight of the total formulation; and the solid component comprises about 5-15 wt % alpha olefin sulfonate; about 40-97 wt % caustic soda; caustic potash or lithium hydroxide; up to about 55 wt. % sodium metasilicate; up to about 5 wt % sodium gluconate; up to about 5 wt % EDTA and up to about 5 wt % propylene glycol based on the weight of the total formulation. In yet another embodiment, the liquid component comprises about 5-15 wt % alpha olefin sulfonate; and up to about 5 wt. % xanthan gum or polyacrylate based on the weight of the total formulation; and the solid component comprises about 40-97 wt % caustic soda; caustic potash or lithium hydroxide; up to about 55% wt. % sodium metasilicate; up to about 5 wt % sodium gluconate; up to about 5 wt % EDTA; and up to about 5 wt % propylene glycol based on the weight of the total formulation.

The invention is further directed to a container comprising a solid component and a liquid component wherein the components collectively constitute an acid formulation. In an embodiment of the acid formulation described hereinabove, the liquid component comprises about 1-20 wt % of a surfactant based on the weight of the total formulation and the solid component comprises up to about 5 wt % of a thickener; about 30-95 wt % of an acid source; up to about 15 wt. % of a chelating agent; up to about 65 wt. % filler; and up to about 5 wt. % of a dust control agent based on the weight of the total formulation. In another embodiment, the liquid component comprises about 0.1-5 wt. % thickener based on the weight of the total formulation and the solid component comprises about 1-20 wt. % surfactant; about 30-95 wt. % acid source; up to about 15 wt. % chelating agent; up to about 65 wt. % filler; and up to about 5 wt. % dust control agent based on the weight of the total formulation. In yet another embodiment, the liquid component comprises about 1-20 wt. % surfactant and up to about 5 wt. % thickener based on the weight of the total formulation; and the solid component comprises about 30-95 wt. % acid source; up to about 15 wt. % chelating agent; up to about 65 wt. % filler; and up to about 5 wt. % dust control agent based on the weight of the total formulation. In the compositions hereinabove described, the acid source comprises sulfamic acid, citric acid, glycolic acid, trichloroacetic acid, maleic acid or mixtures thereof. The acid source may further comprise a fluoride salt.

In one embodiment of an acid formulation described above, the liquid component comprises about 2-5 wt. % of alpha olefin sulfonate based on the weight of the total formulation; and the solid component comprises about 1-5 wt. % xanthan gum or polyacrylate; about 25-60 wt. % ammonium bifluoride; about 30-72 wt. % organic acid; up to about 2 wt. % EDTA; up to about 40 wt. % sodium metasilicate; and up to about 2 wt. % propylene glycol based on the weight of the total formulation. In another embodiment, the liquid component comprises about 1-5 wt. % xanthan gum or polyacrylate based on the weight of the total formulation; and the solid component comprises about 2-5 wt. % alpha olefin sulfonate; about 25-60 wt. % ammonium bifluoride; about 30-72 wt. % of an organic acid; up to about 2 wt. % EDTA; up to about 40 wt. % sodium metasilicate; and up to about 2 wt. % propylene glycol based on the weight of the total formulation. In yet another embodiment, the liquid component comprises about 2-5 wt. % alpha olefin sulfonate and about 1-5 wt. % xanthan gum or polyacrylate based on the weight of the total formulation; and the solid component comprises about 25-60 wt. % ammonium bifluoride; about 30-72 wt. % organic acid; up to about 2 wt. % EDTA; up to about 40 wt. % sodium metasilicate; and up to about 2 wt. % propylene glycol based on the weight of the total formulation. In the above described compositions, the organic acid is sulfamic acid, citric acid or mixtures thereof.

EXAMPLES

The following examples, which are by no means limiting, will permit a better understanding of the invention and its advantages and certain variations of execution.

Example 1

Alkaline-Based Coil Cleaner

A caustic powder of the invention having the following composition has been studied with regard to cleaning capability and odor removal: 77 wt. % caustic soda, 8 wt. % alpha olefin sulfonate, 0.5-1 wt. % xanthan gum or polyacrylate, 10 wt. % sodium gluconate; 2 wt. % EDTA; and 2 wt. % propylene glycol.

In one test Crisco cooking grease was applied as a 2 mm film to a galvanized sheet metal strip. The strip was immersed in a cleaning solution prepared by mixing 8 oz of the powder in one gallon of water. Thirty minutes after immersion the strip was rinsed with cool water. The strip immersed in the cleaning solution of the invention was completely grease-free.

In a second test, aluminum foil was rolled into a thin tube and a lit cigarette placed inside. Sufficient ventilation to maintain combustion of the cigarette was provided until no tobacco remained. The ashes were dumped and the foil unrolled to provide nicotine and tar covered aluminum samples. The samples were immersed in water (control) or the cleaning solution of the invention, as prepared above. After fifteen minutes the samples were removed and rinsed with cool water. The control sample showed no signs of cleaning and still smelled strongly of nicotine and smoke. The sample treated with the cleaning solution of the invention was completely free of both odor and nicotine/tar staining.

Example 2

Acid-Based Coil Cleaner

A powder of the invention having the following composition has been studied with regard to cleaning capability and odor removal: 31 wt. % ammonium bifluoride, 62 wt. % sulfamic acid, 3 wt. % alpha olefin sulfonate, 0.5-1 wt. % xanthan gum or polyacrylate, and 2 wt. % EDTA.

In one test Crisco cooking grease was applied as a 2 mm film to a galvanized sheet metal strip. The strip was immersed in a cleaning solution prepared by mixing 8 oz of the powder in one gallon of water. Thirty minutes after immersion the strip was rinsed with cool water. The strip immersed in the cleaning solution of the invention was completely grease-free.

In a second test, aluminum foil was rolled into a thin tube and a lit cigarette placed inside. Sufficient ventilation to maintain combustion of the cigarette was provided until no tobacco remained. The ashes were dumped and the foil unrolled to provide nicotine and tar covered aluminum samples. The samples were immersed in water (control) or the cleaning solution of the invention, as prepared above. After fifteen minutes the samples were removed and rinsed with cool water. The control sample showed no signs of cleaning and still smelled strongly of nicotine and smoke. The sample treated with the cleaning solution of the invention was completely free of both odor and nicotine/tar staining.

Example 3

Evaluation of Surfactants

The surfactants listed in Table 1 have been evaluated with regard to their suitability for incorporation into the powder coil cleaners of the current invention. The parameters evaluated were solubility, detergency, foam height, lipophilicity of nonionic surfactants (hydrophile-lipophile-balance, HLB number), and wetting. Wetting and detergency were based on cleaning of a metal strip which had been coated with cooking grease. The parameters were scored as follows: Detergency (1=lowest, 5=highest); Solubility (1=lowest, 5=highest); Wetting (1=lowest, 5=highest); HLB (hydrophilicity; 1=least, 40=most); and Foam Height (Low, Medium High; relative, following agitation of the formulation for 15 seconds). Additionally, combinations of these materials were also evaluated. In a typical analysis 0.3 grams of surfactant was dissolved in 50 ml of tap water. The results are summarized in Table 1.

Further, each surfactant with solubility equal to or greater than 3 was incorporated into a fully formulated product and tested as described in Examples 1 and 2. These formulations were based on the optimal conditions set forth in the patent. The relative results from the formulations were identical to those presented in Table 1; for example, comparison of a fully formulated product containing Mackam 1200 and one containing Bioterge AS-90 provide the same relative solubilities, wetting, and detergency as those presented in Table 1.

TABLE 1

| Surfactant | Active Ingredient | Type | Detergency | Solubility | Foam | HLB | Wetting |
|---|---|---|---|---|---|---|---|
| Witconate AOK | alpha olefin sulfonate | Anionic | 4 | 5 | H | | 2 |
| Mackam 1200 | lauramidopropyl betaine | Nonionic | 5 | 5 | L | | 4 |
| Mackam LO-100 | Disodium lauryl sulfosuccinate | Anionic | 3 | 4 | M | | 1 |
| Petro 22-Powder | sodium naphthalene sulfonate | Anionic | 1 | 5 | M | | 2 |
| ACME-SLS | sodium lauryl sulfonate | Anionic | 5 | 1 | M | | 5 |
| Nacconol 90 G | sodium dodecyl benzene sulfonate | Anionic | 5 | 2 | L | | 5 |
| Geropon T 77 | sodium oleyl methyl taurate | Anionic | 1 | 3 | H | | 4 |
| Alkamide C-212 | N-(2-hydroxyethyl) dodecanamide | Nonionic | 5 | 1 | L | | 1 |
| Bioterge AS-90 | alpha olefin sulfonate | Anionic | 3 | 5 | H | | 3 |
| Deriphat 160 | Disodium Lauryl Iminodipropionate | Anionic | 1 | 5 | M | | 3 |
| S-Maz 65 k | Sorbitan tristearate | Nonionic | 1 | 1 | L | | 1 |
| S-Maz 60 k | Sorbitan monostearate | Nonionic | 1 | 1 | L | | 1 |
| Mazol GMS | glycerol Monostearate | Nonionic | 1 | 1 | L | | 1 |

TABLE 1-continued

| Surfactant | Active Ingredient | Type | Detergency | Solubility | Foam | HLB | Wetting |
|---|---|---|---|---|---|---|---|
| Mapeg 6000 DS | polyethyleneglycol distearate | Nonionic | 1 | 2 | L | | 1 |
| Mapeg S 40 K | polyethyleneglycol monostearate | Nonionic | 1 | 2 | L | | 1 |
| Pluronic F 88 | PEG/PPG Copolymer MW 11.4 K | Nonionic | 1 | 3 | L | >24 | 2 |
| Pluronic F 98 | PEG/PPG Copolymer MW 13 K | Nonionic | 1 | 3 | L | >24 | 2 |
| Pluronic F 38 | PEG/PPG Copolymer MW 4.7 K | Nonionic | 1 | 5 | L | >24 | 1 |
| Pluronic F 68 | PEG/PPG Copolymer MW 8.4 K | Nonionic | 1 | 3 | L | >24 | 1 |
| Pluronic F 77 | PEG/PPG Copolymer MW 6.6 K | Nonionic | 1 | 4 | L | >24 | 1 |
| Pluronic F 87 | PEG/PPG Copolymer MW 7.7 K | Nonionic | 1 | 4 | L | >24 | 1 |
| Pluronic F 127 | PEG/PPG Copolymer MW 12.6 K 1:2 | Nonionic | 1 | 3 | L | 18-23 | 1 |
| Pluronic F 108 | PEG/PPG Copolymer MW 14.6 k 1:3 | Nonionic | 2 | 1 | L | >24 | 2 |
| Lutensol NP100 | alcohol ethoxylate (nonylphenyl) MW 4.3 K | Nonionic | 1 | 3 | L | >20 | 2 |
| Lutensol AT 25 | alcohol ethoxylate (nonylphenyl) MW 1450 | Nonionic | 1 | 1 | L | 20 | 3 |
| Lutensol AT 55 | alcohol ethoxylate (nonylphenyl) MW 2670 | Nonionic | 1 | 1 | L | 24 | 2 |
| Jordapon CI | sodium cocoylisethionate | Anionic | 4 | 2 | H | | 4 |
| Tetronic 1307 | PEG/PPG oxylated ethylendiamine MW 18 K | Nonionic | 1 | 1 | L | >24 | 2 |
| Tetronic 1107 | PEG/PPG oxylated ethylendiamine MW 15 K | Nonionic | 1 | 1 | L | 18-23 | 1 |
| Naxan | sodium naphthalene sulfonate | Anionic | 2 | 5 | L | | 2 |

Detergency 1 = Lowest 5 = Best
Solubility 1 = Lowest 5 = Highest
Foam Height: Low Medium High
Wetting 1 = Lowest 5 = Best
Wetting and Detergency based on cleaning of metal strip coated with cooking grease All of the materials listed in Table 1 could be used in mixtures or as the sole surfactant in the formulations. For formulations comprising Mackam 1200 or other non-ionic surfactants which may have excellent results if not for low foam, a small amount of anionic or cationic surfactant may be added for improved foaming without loss of performance.

The formulation containing Mackam 1200 results in a very viscous solution in cases of high alkalinity. Therefore, in this example, a thickening agent such as xantham gum is not necessary or desirable.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above methods and compositions without departing from the scope of the invention, it is intended that all matter contained in the above description shall be interpreted as illustrative and not in a limiting sense.

The invention claimed is:

1. A method of cleaning an evaporator coil, an air conditioning coil, an electric air filter, or other metal filter or metal coil, said method comprising:

(a) mixing a pre-measured amount of a powdered coil cleaner composition into about 0.5 to about 3 gallons of water to create a solution; and (b) spraying said solution onto the filter or the coil;

wherein the powdered coil cleaner composition comprises:

about 40-97 wt. % strong alkali comprised of caustic soda, caustic potash, lithium hydroxide, sodium carbonate, lithium carbonate or potassium carbonate;

about 1-20 wt. % surfactant;

up to about 5 wt. % thickener;

up to about 15 wt. % chelating agent;

up to about 5 wt. % dust control agent; and up to about 65 wt. % filler.

2. The method of claim 1 comprising:

about 70-80 wt. % caustic soda, caustic potash, lithium hydroxide, sodium carbonate, lithium carbonate or potassium carbonate; about 5-15 wt. % alpha olefin sulfonate;

up to about 5 wt. % xanthan gum or polyacrylate;

up to about 5 wt. % sodium gluconate;

up to about 5 wt. % EDTA; and up to about 5 wt. % propylene glycol.

3. The method of claim 1 wherein the surfactant comprises anionic, nonionic or cationic surfactants.

4. The method of claim 1 wherein the surfactant comprises alkyl amido betaines, aryl sulfonates, alkyl sulfonates, alkenyl sulfonates, alkyl carboxylates, substituted alkyl carboxylates, polyalkylene glycol carboxylates, sorbitan tristearate, sodium cocoylisethionate, polymeric alcohol ethoxylates, polyethylene glycol/polypropylene glycol (PEG/PPG) copolymers, PEG/PPG alkylenediamine, fatty acid alkylamino alkylamides, polyalkylene glycol alkylamides, hydrogenated fat alkylamides, N-substituted alkylamides, or mixtures thereof.

5. The method of claim 1 wherein the surfactant comprises lauramidopropyl betaine, disodium lauryl sulfosuccinate, sodium naphthalene sulfonate, sodium lauryl sulfonate, sodium dodecyl benzene sulfonate, sodium oleyl methyl taurate, alpha olefin sulfonate, disodium lauryl iminodipropionate, sorbitan tristearate, sorbitan monostearate, glycerol monostearate, polyethyleneglycol distearate, polyethyleneglycol monostearate, PEG/PPG copolymers, alcohol ethoxylate (nonylphenyl), sodium cocoylisethionate, PEG/PPG oxylated ethylendiamine, N-substituted alkylamide, PEG alkylamide, PPG alkylamide, hydrogenated palm alkylamide, hydrogenated tallow alkylamide, or mixtures thereof.

6. The method of claim 1 wherein the surfactant comprises an alpha olefin sulfonate, sodium lauryl sulfate, dodecyl benzyl sulfonate, or N-(2-hydroxyethyl) dodecanamide.

7. The method of claim 1 further comprising about 5-15 wt. % chelating agent.

8. The method of claim 7 wherein the chelating agent comprises a salt of phosphonic acid, sulfonic acid, polycarboxylic acid, aminocarboxylic acid or hydroxycarboxylic acid.

9. The method of claim 7 wherein the chelating agent comprises a salt of nitrilotrismethylene phosphonic acid, sulfamic acid, EDTA, citric acid, oxalic acid, glycolic acid or gluconic acid.

10. The method of claim 1 comprising from about 0.1-4 wt. % of a thickener.

11. The method of claim 10 wherein the thickener comprises xanthan gum, a polyacrylic thickener, guar gum, polyvinyl alcohol or a cellulosic thickener.

12. The method of claim 1 comprising from about 0.1-4 wt. % of a dust control agent.

13. The method of claim 12 wherein the dust control agent comprises hydrolyzed sugar, ethylene glycol or propylene glycol.

14. The method of claim 1 wherein the composition comprises about 5-35 wt. % filler.

* * * * *

UNITED STATES PATENT AND TRADEMARK OFFICE

CERTIFICATE OF CORRECTION

PATENT NO. : 7,662,238 B2
APPLICATION NO. : 11/756495
DATED : February 16, 2010
INVENTOR(S) : Garner et al.

It is certified that error appears in the above-identified patent and that said Letters Patent is hereby corrected as shown below:

On the title page item 73, Assignee:

"Germany Company, Inc., Valley Park, MO (US)"

should read

-- Garman Company, Inc., Valley Park, MO (US) --.

Signed and Sealed this

Twentieth Day of July, 2010

David J. Kappos

David J. Kappos
*Director of the United States Patent and Trademark Office*